US005208065A

United States Patent [19]

Osaka et al.

[11] Patent Number: 5,208,065

[45] Date of Patent: May 4, 1993

[54] PROCESS FOR THE FORMATION OF UNDERCOAT FOR CRT METAL BACK LAYER

[75] Inventors: Norihisa Osaka; Yukihiro Ikegami; Kiichiro Ishiguro; Shuichiro Tokuda; Masanori Itakura, all of Nagoya, Japan

[73] Assignee: Mitsubishi Rayon Co., Ltd., Tokyo, Japan

[21] Appl. No.: 731,477

[22] Filed: Jul. 17, 1991

[30] Foreign Application Priority Data

Jul. 19, 1990 [JP] Japan ..... 2-191448

[51] Int. Cl.[5] ..... B05D 5/06

[52] U.S. Cl. ..... 427/64; 427/68; 427/73; 427/407.2; 427/415

[58] Field of Search ..... 427/64, 407.2, 73, 383.5, 427/415, 68

[56] References Cited

U.S. PATENT DOCUMENTS

| | | | |
|---|---|---|---|
| 3,839,068 | 10/1974 | Miura | 427/68 |
| 4,247,612 | 1/1981 | Nishizawa et al. | 427/64 |
| 4,293,586 | 10/1981 | Unnai et al. | 427/68 |
| 4,657,961 | 4/1987 | Nishizawa et al. | 427/68 |
| 4,746,588 | 5/1988 | Ditty et al. | 427/73 |
| 5,039,551 | 8/1991 | Fujita | 427/68 |
| 5,073,463 | 12/1991 | Fujital | 427/68 |

FOREIGN PATENT DOCUMENTS

| | | | |
|---|---|---|---|
| 587419 | 11/1959 | Canada | 427/64 |
| 5251942 | 10/1975 | Japan | 427/64 |
| 58109165 | 1/1985 | Japan | 427/64 |

*Primary Examiner*—Shrive Beck
*Assistant Examiner*—Diana Dudash
*Attorney, Agent, or Firm*—Oblon, Spivak, McClelland, Maier & Neustadt

[57] ABSTRACT

A process is described for the formation of an undercoat which is in turn useful in forming a CRT metal back layer. According to the process, a pretreatment composition is coated on a glass panel having a fluorescent layer overlaid thereon, so that a water film is formed. The pretreatment composition is composed of 2–20 wt. % of an alkyl monoalcohol having a $C_{1-3}$ alkyl group, 0.05–1 wt. % of a water-soluble, high molecular compound and 79–97.95 wt. % of water. An undercoating composition is then coated on the water film by a wet-on-wet coating method, whereby a coating layer is formed. The undercoating composition is composed of 1–7 parts by weight of an acrylic resin, which has been obtained by polymerizing 90–100 wt. % of an alkyl methacrylate having a $C_{1-4}$ alkyl group other than tert-butyl methacrylate and 0–10 wt. % of an ethylenically unsaturated monomer copolymerizable therewith, and 99–93 parts by weight of a solvent containing at least 80 wt. % of toluene. The sum of the acrylic resin and the solvent is 100 parts by weight. The water film and the coating layer are dried to form the undercoat.

4 Claims, No Drawings

PROCESS FOR THE FORMATION OF UNDERCOAT FOR CRT METAL BACK LAYER

BACKGROUND OF THE INVENTION

Field of the Invention

This invention relates to a process for the formation of an undercoat useful in forming a metal back layer, which makes use of a metal such as aluminum, on a fluorescent screen of a cathode ray tube (hereinafter abbreviated as "CRT").

Description of the Related Art

CRTs are used as displays for various applications. In keeping abreast of the diversification and ever-higher density of information in recent years, still higher performance, especially high-definition display, is required. As definition becomes higher, however, luminance drops so that in practice a limitation is obviously imposed on the degree of definition achievable.

To avoid reduction in luminance while providing higher definition, a technique has heretofore been employed in which, subsequent to the formation of a fluorescent layer, a metal back layer using a metal such as aluminum is formed to make use of its reflection.

According to the technique, in general, a film is formed on a fluorescent layer by using an emulsion of a resin in water, followed by the formation of a metal back layer on the film. As an alternative, a water film is formed on a fluorescent layer, a resin dissolved in a solvent is applied as a resin film on the water film, and a metal back layer is then formed on the resin film.

Of the conventional two processes described above, the process which uses an emulsion for the formation of a metal back layer is accompanied by a limitation on the degree of smoothness of the metal back layer to be formed because a great deal of gas evaporates during baking and this causes the metal back layer to bulge out from the fluorescent layer due to the evaporating gas (i.e., the so-called "blister"). On the other hand, the process which uses a resin dissolved in a solvent for the formation of a metal back layer is accompanied by such drawbacks as a water film cannot be formed easily or, even when formed, the water film lacks smoothness because the fluorescent layer has water repellency. In addition, it is difficult to form a uniform layer of solvent-base resin on a water film. This process involves practical problems such as the formation of irregularities, pinholes or cracks on the film surface.

In particular, a formation of a water film considerably affects the smoothness of a solvent-base resin layer to be formed on the water film. Many proposals have heretofore been made in this regard, for example, the formation of a thin film of an organic, high molecular substance subsequent to wetting a fluorescent layer with an aqueous solution of polyvinyl alcohol or gum arabic (Japanese Patent Publication No. 25659/1968), and the use of an aqueous solution of water-glass, said solution having been adjusted to a particular pH (Japanese Patent Laid-Open No. 232528/1986); and, as materials for attaining the above object, alcohols (Japanese Patent Laid-Open No. 4476/1974), cellulose derivatives, alginic acid derivatives or polyethylene oxide (Japanese Patent Laid-Open No. 192243/1983), dihydric or trihydric alcohols (Japanese Patent Laid-Open No. 218735/1985), and saturated aqueous solutions of water-soluble solvents (Japanese Patent Laid-Open No. 195540/1986).

None of the above water-film-forming compositions are however sufficient when evaluated from industrial viewpoints such as workability or when judged with respect to the performance required in recent years, i.e., the need for high definition and high luminance. No composition has heretofore been available, which can facilitate the formation of a solvent-base resin layer with sufficient smoothness while retaining high wetting power to a fluorescent screen.

Upon formation of a solvent-base resin film on a water film, higher luminance requires higher smoothness of the resin film. Further, as the area of the solvent-base resin film increases, more gas is produced in total during baking so that the thickness of the film must be reduced. This however results in a very large area-to-thickness ratio, thereby making it difficult to form a film. No composition has therefore been obtained for the formation of a solvent-base resin film suited to both high luminance and high definition.

As a factor which makes the formation of such an undercoat more difficult, the formation of a thin film on a water film, namely, the reliance upon the wet-on-wet method is mentioned. The formation of a thin, solvent-base resin film on a water film involves certain technical difficulties: because of their lower viscosities, interfacial disturbance tends to occur upon coating; the water film must be maintained at a predetermined height relative to the fluorescent screen during coating; and the formation of the film ought to be conducted while taking into due consideration the drying rates of the two films and consequent viscosity variations.

SUMMARY OF THE INVENTION

An object of the present invention is to provide a process for the formation of a smooth, pinhole- or crack-free undercoat on a fluorescent screen of a CRT, said undercoat being useful in providing a smooth metal back layer suited for a high-luminance and high-definition CRT.

Another object of the present invention is to provide a pretreatment composition for the formation of a smooth water film useful upon formation of an undercoat which is in turn useful in forming a metal back layer of a CRT.

A further object of the present invention is to provide an undercoating composition which can form - in a smooth and, moreover, pinhole- and crack-free state -an undercoat useful in forming a metal back layer of a CRT.

The process of the present invention for the formation of an undercoat for a CRT metal back layer comprises the following steps (A), (B) and (C):

(A) coating a pretreatment composition, which comprises 2–20 wt. % of an alkyl monoalcohol having a $C_{1-3}$ alkyl group, 0.05–1 wt. % of a water-soluble, high molecular compound and 79–97.95 wt. % of water, on a glass panel having a fluorescent layer overlaid thereon, whereby a water film is formed;

(B) coating an undercoating composition, which comprises (B-1) 1–7 parts by weight of an acrylic resin obtained by polymerizing 90–100 wt. % of an alkyl methacrylate having a $C_{1-4}$ alkyl group other than tert-butyl methacrylate and 0–10 wt. % of an ethylenically unsaturated monomer copolymerizable therewith and (B-2) 99–93 parts by weight of a solvent containing at least 80 wt. % of toluene, the sum of said acrylic resin (B-1) and said solvent (B-2) being 100 parts by weight, on the water film by a wet-on-wet coating method, whereby a coating layer is formed; and (C) drying the water film and the coating layer to form the undercoat.

DETAILED DESCRIPTION OF THE INVENTION

According to the process of the present invention for the formation of an undercoat for a CRT metal back layer, the pretreatment composition is first coated, in step (A), on the glass panel having the fluorescent layer overlaid thereon, whereby the water film of the composition is formed.

The pretreatment composition comprises 2–20 wt. % of an alkyl monoalcohol having a $C_{1-3}$ alkyl group, 0.05–1 wt. % of a water-soluble, high molecular compound and 79–97.95 wt. % of water.

The alcohol component is added to improve the wetting power for the fluorescent screen and is an alkyl monoalcohol having a $C_{1-3}$ alkyl group. Specific examples include methyl alcohol, ethyl alcohol, propyl alcohol and isopropyl alcohol as well as combinations of two or more of these alkyl monoalcohols. As the alcohol component, an alkyl monoalcohol containing isopropyl alcohol in a proportion of at least 50 wt. % is preferred from the standpoint of workability.

The proportion of the alcohol component in the pretreatment composition ranges from 2 wt. % to 20 wt. %. Proportions smaller than 2 wt. % lead to low wetting power for fluorescent screens so that no smooth water film can be formed. Proportions greater than 20 wt. % however result in excessively high affinity for a resin solution to be coated next, resulting in the formation of a resin film which tends to be uneven and to contain more pinholes and cracks. In addition, the drying of the pretreatment composition tends to take place so quick that the resulting thin film undergoes substantial surface changes and develops irregularity in the surface upon its coating. The preferred proportion of the alcohol component may range from 4 wt. % to 12 wt. %. at which the workability at the time of coating can be improved further.

The water-soluble, high molecular compound is a component added to improve, as a surfactant, the compatibility between the fluorescent layer and the pretreatment composition so that occurrence of irregularity can be avoided. Illustrative examples of the water-soluble, high molecular compound include water-soluble polymers such as polyvinyl alcohol, cellulose derivatives and gum arabic. Polyvinyl alcohol is particularly preferred.

The proportion of the water-soluble, high molecular compound ranges from 0.05 wt. % to 1 wt. %. Proportions smaller than 0.05 wt. % are too small to exhibit effects of the water-soluble, high molecular compound, whereas proportions in excess of 1 wt. % result in the occurrence of irregularity due to an increase in the viscosity of the pretreatment composition.

The combined use of the alkyl monoalcohol and the water-soluble, high molecular compound can provide workability better than that available from their single use, and also furnishes a final undercoat which is smooth and moreover is free of pinholes or cracks. The use of the alkyl monoalcohol having low surface tension and high water solubility has made it possible to form a water film in a similar manner irrespective of the conditions of a fluorescent screen, namely, whether the fluorescent screen is dry and has high water repellency or is undried and has high hydrophilic nature. Although the initial wetting velocity is lower than that of the alkyl monoalcohol, the use of the water-soluble, high molecular compound which is highly effective as a surfactant has made it possible to allow the resultant water film to retain good smoothness even when the alcohol component progressively evaporated after the formation of the water film. The combined use of the alkyl monoalcohol and the water-soluble, high molecular compound has therefore brought about advantageous effects unavailable from the conventional art, namely, the advantageous effects that the formation of a water film can be completed in a short time and, since the smoothness of the water film thus formed remains good for a longer time, higher productivity and greater working flexibility can be enjoyed.

Upon formation of the water film by coating the pretreatment composition on the glass panel having the fluorescent layer overlaid thereon, a conventional coater such as a spin coater can be used. As the coating method, various methods can be used such as curtain coating, pour coating through a nozzle, e.g., a tube, spray coating, and the like. Curtain coating or pour coating, which features reduced incorporation of bubbles, is preferred.

It is desirable to make the water film of the pretreatment composition, which has been coated on the glass panel having the fluorescent layer overlaid thereon, uniform and smooth approximately to the height of fluorescent stripes by spinning or the like. Film thicknesses greater than the height of the fluorescent stripes are not preferred because vent holes for gas can no longer be formed in the associated metal back layers and "blister" occurs. On the other hand, film thicknesses smaller than the height of the fluorescent stripes are not preferred either because the associated metal back layers become no longer smooth and the luminances tend to drop.

The process of the present invention for the formation of the undercoat for the CRT metal back layer further includes step (B), in which an undercoating composition is coated by the wet-on-wet method on the water film formed in step (A).

The undercoating composition used in the present invention comprises (B-1) 1–7 parts by weight of an acrylic resin obtained by polymerizing 90–100 wt. % of an alkyl methacrylate having a $C_{1-4}$ alkyl group other than tert-butyl methacrylate and 0–10 wt. % of an ethylenically unsaturated monomer copolymerizable therewith and (B-2) 99–93 parts by weight of a solvent containing at least 80 wt. % of toluene, the sum of said acrylic resin (B-1) and said solvent (B-2) being 100 parts by weight.

As the alkyl methacrylate component forming the acrylic resin, one capable of meeting certain conditions such as good bake properties and an low impurity level is chosen. The alkyl methacrylate component features the exclusion of baking residues or impurities which may cause problems under severe conditions of the inner wall of a CRT, that is, exposure to electron beams in a high vacuum, in particular, heavy metals, halogens and the like. The ethylenically unsaturated monomer which is employed in the range of 0–10 wt. % as the other component for the formation of the acrylic resin has to be chosen from the same viewpoint, too. Its specific examples include tert-butyl methacrylate; alkyl acrylates having a $C_{1-18}$ alkyl group such as methyl acrylate, ethyl acrylate, octyl acrylate, lauryl acrylate and dodecyl acrylate; alkyl methacrylates having a $C_{5-18}$ alkyl group such as pentyl methacrylate, heptyl methacrylate, octyl methacrylate, lauryl methacrylate and dodecyl methacrylate hydroxylcontaining alkyl (meth)acrylates such as hydroxyethyl methacrylate; carboxyl-containing monomers such as acrylic acid and methacrylic acid; monomers containing one or more basic groups, such as dimethyl aminoethyl(meth)acrylate; silane-type (meth)acrylates such as trimethoxysilyl methacrylate; styrene monomers; and vinyl monomers such as vinyl acetate.

The monomers chosen to form the acrylic resin are polymerized usually by a conventional process. Suspension polymerization or bulk polymerization, which results in less impurity residues, is recommended. Where the acrylic resin is a copolymer of plural monomers, it is necessary to adjust the balance between the amount of gas to be produced during baking and the heating rate because the velocities of decomposition to the individual monomers through depolymerization are different. Excessive gas production results in blisters, while unduly little gas production requires too much time for the baking step and hence makes the process impractical. The most preferable acrylic resin is a polymer containing isobutyl methacrylate as a constituent monomer unit in a proportion of 70% or more.

The molecular weight of the acrylic resin serves as a predominant factor for determining the viscosity of an undercoating composition to be prepared by dissolution of the acrylic resin in a solvent, whereby the molecular weight of the acrylic resin governs the tolerance of working conditions, in other words, the productivity and yield. The molecular weight may preferably range from 40,000 to 300,000. Molecular weights smaller than 40,000 lead to insufficient strength upon formation of a film so that defects such as cracks and/or pinholes tend to occur. Molecular weights greater than 300,000 however make it difficult to achieve good balance between the viscosity of the resin solution at the time of formation of the film and that of the resin solution at the time of drying of the film, whereby the resulting film tends to contain irregularity. The more preferred range is from 150,000 to 300,000, within which the resulting undercoat contains fewer pinholes and, even when its thickness is as small as 3 μm or less, it has strength sufficient to withstand the subsequent steps such as the vacuum deposition of aluminum.

As the solvent employed in the undercoating composition, one having no affinity for the water film already coated on the fluorescent layer is desired. An organic solvent containing toluene in a proportion of 80 wt. % or more is preferred. The solvent determines the drying rate during the coating, and significantly affects the formation of a film. To uniformly form a solvent-base resin film of several micrometers or thinner on a screen of 29 inches or greater, toluene is preferred.

Exemplary organic solvents which are usable in a proportion of 20 wt. % or less in combination with toluene include acetic acid esters such as ethyl acetate; ketones such as methyl ethyl ketone; aromatic compounds such as xylene; alcohols; aliphatic solvents; and ethers and esters of polyhydric alcohols. If the proportion of toluene should be smaller than 80 wt. %, it is extremely difficult to form a uniform undercoat.

When the viscosity of the undercoating composition falls within the range of from 1 centistoke to 5 centistokes, the coating conditions can have a wide tolerance so that CRTs ranging from CRTs as small as several inches to CRTs as large as 30 inches or greater can be coated without irregularity. Although the optimum range of the concentration of the resin in the undercoating composition varies depending on the molecular weight of the resin and the coating conditions, the concentration may generally be at least 1 wt. % but not greater than 7 wt. %. Concentrations smaller than 1 wt. % result in a thinner undercoat film whose strength is so low that irregularity or damages will occur in a metal back layer to be vacuum deposited. Concentrations greater than 7 wt. % lead to the production of abundant gas and hence to the occurrence of blisters when the film thickness becomes very large, and also results in the development of irregularity in the resultant film due to the high viscosity of undercoating compositions.

As a method for coating in a wet-on-wet state a film of the undercoating composition on the surface of the water film, spray coating may be mentioned as a preferred example although not limited specifically thereto.

Wet-on-wet coating can form a smooth and thin film, thereby making it possible to substantially reduce the amount of the film-forming material to be carried into the baking step subsequent to the formation of the film and the drying of the conditioner composition. The thickness of a film formed by this method is usually 1–2 μm.

The undercoat applied on the water film as described above is dried in step (C), whereby an undercoat layer is formed.

As to drying conditions which can be adopted for step (C), the drying temperature may generally range from room temperature to 150° C. although it varies significantly depending on the flow rate of air, etc. in the process.

The present invention will hereinafter be described in detail by the following examples, in which all designations of "%" and "part or parts" means "wt. %" and "part or parts by weight", respectively.

Production of acrylic resin

Water (800 parts) was placed in a 5-λ, 4-necked flask, followed by dissolution of 1 part of polyvinyl alcohol (saponification degree: 88%; polymerization degree: 1,000). A monomer solution which had been prepared by dissolving 2.0 parts of azobisisobutyronitrile in 100 parts of isobutyl methacrylate was poured into the flask. After the flask was purged with nitrogen gas, the contents were heated at 80° C. with vigorous stirring under a nitrogen gas stream. Two hours later, the temperature was raised to 90° C., at which the contents were heated for additional two hours. The contents were then heated to 120° C. so that any remaining monomers were distilled out with water. A slurry so obtained was filtered to collect a solid matter. The solid matter was washed and dried in a hot-air dryer controlled at 50° C., whereby an acrylic resin (Sample A) was obtained as white particulate powder. Its rate of polymerization and molecular weight were 98% and 100,000, respectively.

By a similar polymerization process, the following acrylic resins (Samples B, C, D and E) were obtained.

TABLE 1

| Sample | Composition (%) | Rate of polymerization (%) | Molecular weight |
|---|---|---|---|
| B | EMA = 100 | 95 | 100,000 |
| C | EMA/MMA = 80/20 | 98 | 80,000 |
| D | MMA/EA = 95/5 | 90 | 70,000 |

TABLE 1-continued

| Sample | Composition (%) | Rate of polymerization (%) | Molecular weight |
|---|---|---|---|
| E | MMA/St = 50/50 | 85 | 40,000 |

(Note)
EMA: Ethyl methacrylate,
MMA: Methyl methacrylate,
EA: Ethyl acrylate,
St: Styrene.

EXAMPLE 1

An undercoating composition prepared by dissolving 6 parts of the acrylic resin (Sample A) per 100 parts of toluene as a solvent was spray coated on a fluorescent screen of a CRT of 29 inches wide. A water film had been formed in advance on the fluorescent screen, using a pretreatment composition composed of 92.5% of deionized water, 0.5% of polyvinyl alcohol (saponification degree 88%; polymerization degree: 2,400), 5.0% of isopropyl alcohol and 2.0% of ethyl alcohol. After the solvent and water were dried off to form an undercoat, aluminum was vacuum deposited on the undercoat. The resultant tube was processed further through steps such as baking, whereby a color CRT was obtained. The luminance of the color CRT thus obtained was measured It was free of luminance irregularity. The results are shown in Table 2.

EXAMPLES 2–4

Color CRTs were fabricated in exactly the same manner as in Example 1 except for the use of the acrylic resins shown in Table 1. The performance of each undercoating composition was evaluated.

The results are shown in Table 2.

COMPARATIVE EXAMPLE 1

A color CRT was fabricated in exactly the same manner as in Example 1 except for the use of the acrylic resin (Sample E) as a resin for an undercoating composition.

As a result of evaluation, the undercoat contained substantial irregularity and a lot of residue remained after baking. The CRT was unable to satisfactorily function as a CRT.

COMPARATIVE EXAMPLE 2

A color CRT was obtained in exactly the same manner as in Example 1 except for the use of an undercoating composition composed of 5 parts of the acrylic resin (Sample B), 30% of ethyl acetate, 40% of methyl ethyl ketone and 30% of toluene. The undercoat layer contained substantially irregularity and the luminance was low.

COMPARATIVE EXAMPLE 3

A color CRT was obtained in exactly the same manner as in Example 1 except for the use of an undercoating composition composed of 12 parts of the acrylic resin (Sample C), 90 parts of toluene and 10 parts of ethyl acetate. Aluminum bulges (blisters) were observed in every corner of the fluorescent screen area. Substantial irregularity was also observed all over the screen. The luminance was low.

COMPARATIVE EXAMPLE 4

A coating film was formed on a fluorescent screen by using, as an undercoating composition, an emulsion ("PRIMAL B-74", trade name; product of Japan Acrylic Chemical Co., Ltd.). After the coating film was dried, vacuum deposition of aluminum was conducted. Subsequent to fabrication into a color CRT, its luminance was measured. It is however to be noted that the baking took 5 times as much as the time required in Example 1 because blisters were developed during baking when the baking was conducted under similar conditions to Example 1. The evaluation results of the luminance of the color CRT are shown in Table 2.

TABLE 2

| Example | Relative value of luminance (%) | Remarks |
|---|---|---|
| Ex. 1 | 115 | No irregularity |
| Ex. 2 | 109 | No irregularity |
| Ex. 3 | 110 | No irregularity |
| Ex. 4 | 112 | No irregularity |
| Comp. Ex. 1 | Unmeasurable | Poor baking |
| Comp. Ex. 2 | 45 | Irregularity all over the screen |
| Comp. Ex. 3 | 70 | Blisters in every screen corner |
| Comp. Ex. 4 | 100 | No irregularity |

As is apparent from these results, the process of the present invention can satisfy the technical requirements of CRTs, namely, high luminance and high definition. The use of the process of the present invention has made it possible to realize, compared to the use of conventional emulsions, higher luminance and better workability, i.e., higher productivity and hence to obtain high-luminance CRTs.

EXAMPLE 5

An undercoating composition prepared by dissolving 4 parts of the acrylic resin (Sample A) per 100 parts of toluene was spray coated on a fluorescent screen of a CRT of 29 inches. A water film had been formed in advance on the fluorescent screen, using a pretreatment composition composed of 92.0% of deionized water, 0.5% of polyvinyl alcohol (saponification degree 88%; polymerization degree: 2,400) and 7.5% of isopropyl alcohol. After the solvent and water were dried off, aluminum was vacuum deposited. The resultant tube was processed further through steps such as baking, whereby a color CRT was obtained. The luminance of the color CRT thus obtained was measured. It was free of luminance irregularity The results are shown in Table 3.

COMPARATIVE EXAMPLE 5

Vacuum deposition of aluminum was conducted in exactly the same manner as in Example 5 except for the use of deionized water alone as a pretreatment composition. The area on which an undercoat was formed was as small as 30% or less. Practically no vacuum deposited aluminum film was formed.

COMPARATIVE EXAMPLE 6

A color CRT was obtained in a similar manner to Example 5 except for the use of a pretreatment composition composed of 99.5% of deionized water and 0.5% of polyvinyl alcohol (saponification degree: 88%; polymerization degree: 2,400). Spiral luminance irregularity was observed. The luminance was also low as shown in Table 3.

COMPARATIVE EXAMPLE 7

A color CRT was obtained in a similar manner to Example 5 except for the use of a pretreatment composition composed of 95% of deionized water and 5% of ethyl alcohol. Irregularity was observed in every corner of the fluorescent screen area, and the luminance was low as shown in Table 3.

TABLE 3

| Example | Relative value of luminance (%) | Remarks |
|---|---|---|
| Ex. 5 | 115 | No irregularity |
| Comp. Ex. 5 | Unmeasurable | Poor baking |
| Comp. Ex. 6 | 45 | Irregularity all over the screen |
| Comp. Ex. 7 | 70 | Blisters in every screen corner |

As is apparent from the above examples, the process of the present invention which features the combined use of a specific pretreatment composition and a particular undercoating composition permits the formation of a smooth, pinhole- or crack-free undercoat on a fluorescent screen so that a smooth metal back surface suitable for obtaining a high-luminance and high-definition CRT can be formed.

What is claimed is:

1. A process for the formation of an undercoat for a cathode ray tube (CRT) metal back layer, which comprises the following steps (A), (B) and (C):

(A) coating a pretreatment composition, which comprises 2–20wt. % of an alkyl monoalcohol having a $C_{1-3}$ alkyl group, 0.05–1wt. % of a water-soluble polymer selected from the group consisting of polyvinyl alcohol, cellulose derivatives and gum arabic and 79–97.95 wt. % of water, on a glass panel having a fluorescent layer overlaid thereon, whereby a water film is formed;

(B) coating an undercoating composition, which comprises 1–7 parts by weight of an acrylic resin obtained by polymerizing 90–100 wt. % of an alkyl methacrylate having a $C_{1-4}$ alkyl group other than tert-butyl methacrylate and 0–10 wt. % of an ethylenically unsaturated monomer copolymerizable therewith and 99–93 parts by weight of a solvent containing at least 80 wt. % of toluene, the sum of said acrylic resin and said solvent being 100 parts by weight, on the water film by a wet-on-wet coating method, whereby a coating layer is formed; and (C) drying the water film and the coating layer to form the undercoat.

2. The process of claim 1, wherein the alkyl monoalcohol contains at least 50 wt. % of isopropyl alcohol.

3. The process of claim 1, wherein the watersoluble polymer is polyvinyl alcohol.

4. The process of claim 1, wherein the acrylic resin contains at least 70 wt. % of isobutyl methacrylate as constituent monomer units thereof.

* * * * *